United States Patent [19]

Mott

[11] Patent Number: 4,937,763

[45] Date of Patent: Jun. 26, 1990

[54] METHOD OF SYSTEM STATE ANALYSIS

[75] Inventor: Jack E. Mott, Idaho Falls, Id.

[73] Assignee: E I International, Inc., Idaho Falls, Id.

[21] Appl. No.: 240,262

[22] Filed: Sep. 6, 1988

[51] Int. Cl.[5] ..... G08B 17/00

[52] U.S. Cl. ..... 364/550; 364/551.01; 364/148

[58] Field of Search ..... 364/550, 551.01, 552, 364/150, 571.02, 571.05; 364/492, 496, 148

[56] References Cited

U.S. PATENT DOCUMENTS

| | | | |
|---|---|---|---|
| 4,639,882 | 1/1987 | Keats | 364/550 |
| 4,707,796 | 11/1987 | Calabro et al. | 364/550 |
| 4,761,748 | 8/1988 | Le Rat et al. | 364/551.01 |
| 4,796,205 | 1/1989 | Ishii et al. | 364/550 |
| 4,823,290 | 4/1989 | Fasack et al. | 364/550 |

*Primary Examiner*—Parshotam S. Lall
*Assistant Examiner*—Michael Zanelli
*Attorney, Agent, or Firm*—Hopkins, French, Crockett, Springer & Hoopes

[57] ABSTRACT

A process for monitoring a system by comparing learned observations acquired when the system is running in an acceptable state with current observations acquired at periodic intervals thereafter to determine if the process is currently running in an acceptable state. The process enables an operator to determine whether or not a system parameter measurement indicated as outside preset prediction limits is in fact an invalid signal resulting from faulty instrumentation. The process also enables an operator to identify signals which are trending toward malfunction prior to an adverse impact on the overall process.

4 Claims, 4 Drawing Sheets

METHOD OF SYSTEM STATE ANALYSIS

BACKGROUND OF THE INVENTION

Very large, dynamic and complex industrial systems, such as electric power generating plants, petrochemical refining plants, metallurgical and plastic forming processes, etc., have hundreds if not thousands of individual process parameters or variables which interact with one another to produce the eventual plant or process output. For example, when a nuclear power plant is constructed, thousands of sensors and monitoring devices are built in to measure temperatures, flows, voltages, pressures, and a myriad of other parameters. The proper functioning of an industrial process is the result of most (or all) of these individual parameters operating within certain ranges of acceptability.

Heretofore, control of such industrial processes has been effected by establishing a list of the most critical parameters, and identifying the range within which each parameter "should" operate. Typically speaking, these parameters are monitored individually, and if any one (or more) parameter moves outside its normal operating range, the operator is alerted to the out-of-standard parameter. However, all such processes are dynamic—that is, individual parameters within the process may change over time, thereby changing the process to some degree, even though it probably continues to operate normally, as the change in one parameter will typically alter the operation of one or more downstream parameters. Presently, plant/process control is effected by observing whether or not all the monitored parameters are within the expected ranges. If so, the plant/-process is presumed to be operating within its designed specifications. However, two major problems arise with this sort of control procedure: (i) if an alarm is sounded, or if a particular parameter moves outside its expected range, an operator has no way of knowing whether or not the alarm is an actual event, or a "false alarm" and (ii) a parameter may be within its expected operating range, but may be trending toward failure, (that is, moving in the direction of soon being outside the normal operating parameters), but an observer presumes the process is operating normally. In the second case, an operator observing the parameter within the normal operating range would perceive no problem with the process when in fact there is a problem which may be too far advanced to easily correct when it finally does move outside the normal operating range. In both cases, a procedure is needed to identify whether or not an alarm signal is in fact a system malfunction, and whether or not various critical parameters are in an acceptable condition or are moving toward failure.

Accordingly, it is an object of the present invention to provide a process whereby numerous parameters in a complex process may be continuously monitored and compared with other process parameters to determine whether or not an alarm signal is an actual failure or a false alarm, and whether or not the critical process parameters are operating in an acceptable condition. Furthermore, the process of the present invention is generally applicable to any system or process regardless of the number of parameters involved and regardless of the manner in which they are expressed.

SUMMARY OF THE INVENTION

The present invention provides a method of indicating when a process, or an individual parameter in the process, is indicated to be operating within an expected range. A number of "learned observations" are made to establish a range of expected operation for a number or parameters which may effect the proper functioning of a particular process. Each of the parameters which is the subject of measurements to establish the learned observation data base is presumed to be correlated with one or more of the other variables so that when the process is operating correctly, it can be assumed that the particular variable should be within expected ranges. Therefore, when a current observation of a particular parameter indicates the parameter to be outside the predicted range, it is presumed to be an erroneous measurement caused by, e.g. faulty instrumentation.

A number of parameters are selected which are deemed to represent those parameters having an effect on the proper functioning of the process. When the process is running in an acceptable state, a number of "learned observations, are recorded arranged in an array and repeated a number of times. A pattern overlap for all pairs of such learned observations is created. Periodically thereafter, at intervals ranging from fractions of seconds to many hours, as appropriate for the system involved, "current observations" are acquired in the same manner as the learned observations. In each case, the observation period may be extremely short (for instance, 0.1 second) or relatively long (a number of minutes). A pattern overlap between the current observations and learned observations is then created.

By combining the pattern overlap of the learned observations with the pattern overlap of the current observation, a combination of learned observations may be created. When the current observation is compared to the combination, the validity of the current observation may be determined; that is, whether or not the current observation and its individual elements lie within the predicted ranges of the combination of learned observations. The result is then indicated in any one of a number of methods, such as numerically (when compared to the expected ranges), graphically, activation of a warning signal (such as a flashing light or buzzer), etc.

It is expected that the process of the present invention may find particular applicability, but by no means be limited to, signal validation processes. For instance, when a number of critical parameters have been identified, and their expected operating ranges preset, an indication by monitoring devices outside such preset range may trigger an action such as shutting down the process. In the event that the allegedly out-of-range parameter is not in fact out of range, but rather the instrument measuring the parameter is faulty, the process of the present invention can "ignore" the invalid signal and continue operating the process normally.

DETAILED DESCRIPTION OF THE INVENTION

Industrial plant process computers collect and compile large amounts of data from plant or process instrumentation. Such data is used to monitor the state of the plant or process to identify and correct problems as they occur. Application of performance and condition monitoring is somewhat limited because access to collected data is limited and no process has heretofore existed which permits a generalized intelligent data analysis. Intelligence in a trending program is desirable so that process signals which are a warning of impending failure or upset can be differentiated from erroneous signals which apparently indicate out-of-specification parameters. Conventional trending analysis identifies where a signal is at the moment of display and where the signal formerly was, but does not indicate where the particular parameter should be. Deviation from historical trends is interpreted to indicate that a process is operating out-of-specification, when in fact the dynamic state of the process may have changed and the specific parameter has changed to meet the new process conditions. Therefore, an improper "false alarm" results. In order to reduce the large number of potential false alarms, wide ranges of parameter operation are typically set within which the parameter should remain. The result is that as a signal drifts toward the outer range limit, it is indicated as "within specification" even though there may be a substantial deviation, and it is not until it actually moves beyond the range that a problem is observed.

Figure 1:
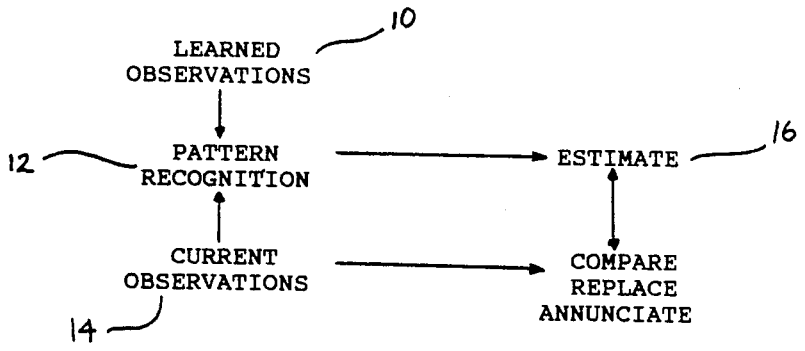
FIG. 1 is a schematic diagram of the process of the present invention.

The process of the present invention overcomes these difficulties by providing a process to indicate the condition of the plant in any of its myriad states. As best illustrated by FIG. 1, the process of the present invention may be briefly described as follows. When the plant or process is operating in an acceptable (if not optimal) condition, a number of "learned observations" 10 are made. Preferably, learned observations are recorded in a broad range of operating conditions when the process is operating in optimal and non-optimal conditions. From these learned observations, a "pattern recognition" 12 sequence is performed so that, in the future, data points may be observed to correspond with the learned observations. Routine surveillance of the process under consideration indicates a number of data points for various operating parameters of the process (the "current observations" 14) which are individually or collectively inserted into the pattern recognition scheme in order to make an estimate 16 of what the current observation should be 14.

The process of the invention is best described by comparison to the conventional process known as a "Kalman filter", see "A New Approach to Linear Filtering and Prediction Problems" R. Kalman, *Journal of Basic Engineering,* Vol. 82, Series D, No. 1, 1960. The Kalman filter is a recursive state estimator with adaptive coefficients that have been successful in a number of complex applications. A typical Kalman filter will model a system dynamically with a time-dependent equation for the abstract system state vector, Xt:

$$dX(t)/dt = A(t)X(t) + W(t), \quad (1)$$

where A(t) is a matrix derived from the process under consideration and W(t) is a vector for a zero-mean white random process added to model uncertainties in the state equations. An observation vector O(t) is related to the state vector by a transformation matrix B(t):

$$O(t) = B(t)X(t) + V(t), \quad (2)$$

where V(t) is a vector for a zero-mean white random process used to model uncertainties in the observations. This process calculates an optimal estimate for the system state vector at a particular time by integrating the first equation to obtain a prior analytic estimate of X(t) and combining it with an observation of the system at time t according to the second equation, to produce a final state estimate of the state vector X(t). This methodology works well for relatively small systems (such as guidance and target tracking systems) for which the equations of state are known, and it provides a means of extrapolating a system trajectory into the near future. However, for large systems the state equations are often difficult to model (and in fact may be impossible to predict or determine), and the uncertainties in both the state equations and the observations must be known, as well as the transformation matrix between the abstract state vector and the observed measurements.

By contrast, the process of the present invention estimates the entire system state using only the observation vector O(t). A number of observations, O(j), the "learned observations", are assembled into a data matrix D. There is no explicit time dependence and the learned observations are differentiated by the index j:

$$D = \{O(j)\}. \quad (3)$$

A current observation O(i) can be used to determine an estimate E(i) for that observation which is a function only of the data matrix D and the current observation O(i):

$$E(i) = E[D, O(i)]. \quad (4)$$

The vector E(i) is analogous to the final state estimate of the Kalman process, and is an observation vector representing the state of the process and not the system state vector itself. The E(i) vector is a result of adaptive coefficients based on current observations, the coefficients being for a linear combination of all the learned states in the data matrix rather than a combination of a single prior estimation and current estimation as in Kalman.

Figure 2:
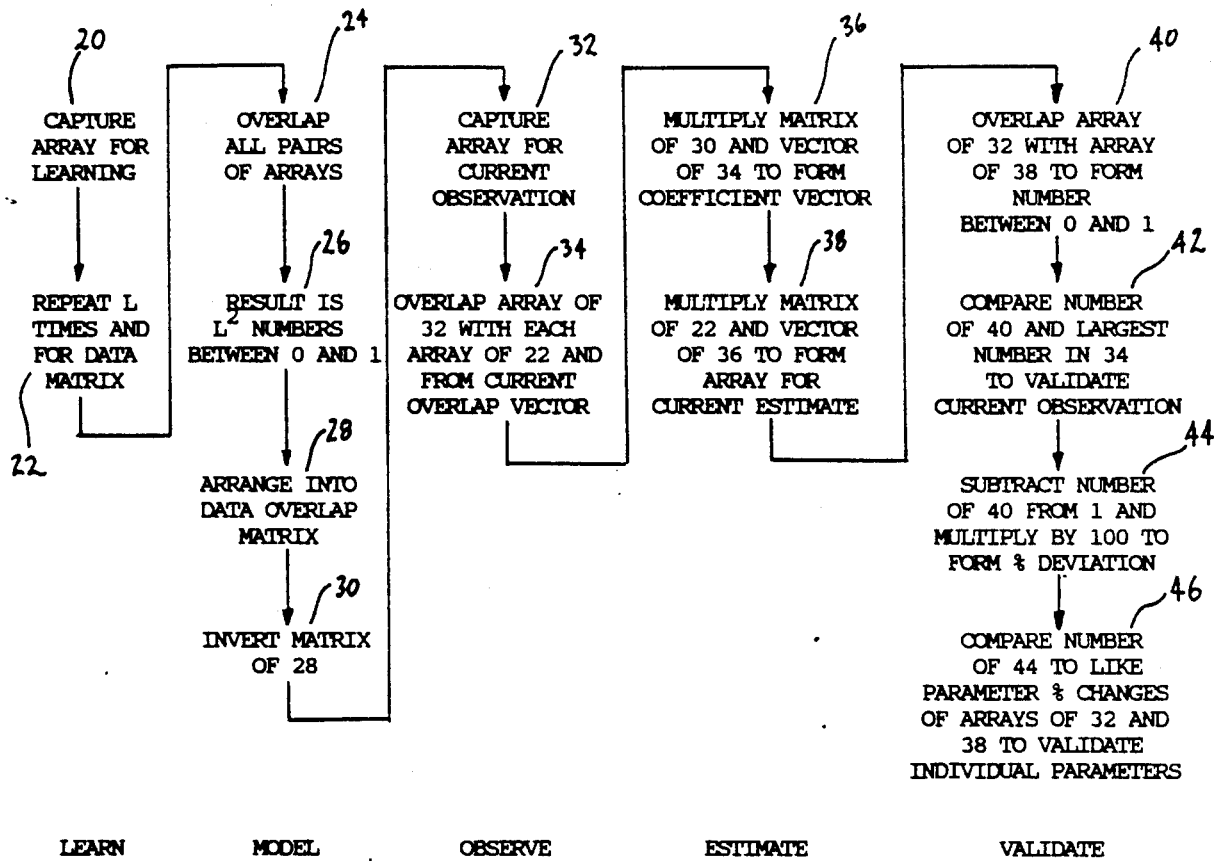
FIG. 2 is a schematic flow chart illustrating the process of the present invention.

The system flow of the process of the present invention may be seen with reference to FIG. 2. First, the system must learn a number of different states of the process upon which subsequent predictions will be based. Therefore, a number of important process parameters are identified (such as temperature, pressure, flow rates, power consumption, etc.) which will indicate the condition the plant or process is in. Arrays of these parameters are captured, at 20, and repeated, 22, while the process is operating in various and different conditions which might be expected to occur in the future. The L arrays 22 are arranged into a data matrix for later use. This is the "learning" state of the present process.

A pattern overlap is constructed, which consists of forming the ratios of all like pairs of process variables, inverting all ratios greater than unity, and averaging all positive values. This is the "pattern recognition" stage which requires that every possible pair of arrays which have been learned must be compared 24 with one another such that each individual signal of an array is compared with each corresponding signal of each of the other arrays. The result 26 of the comparison 24 is a single number between 0 and +1.0. Because each comparison 24 results in a number, the $L^2$ numbers are arranged in an overlap matrix 28. The overlap matrix 28 is thereafter inverted, 30. Therefore, a pattern of various state conditions has been established into which future observations may be related to determine whether or not the future observations "fit" the pattern.

Current observations are captured, 32, in a single array during the normal monitoring of the plant or process. Such observations may be taken at any desired frequency which will result in adequate monitoring of the particular process. This frequency may be from once every few hours, to numerous times per second.

Using the procedure set forth above, another pattern overlap is constructed using current observations. An overlap vector 34 is produced by pairing the current observation with each of the learned observations, forming ratios of all like pairs of process variables, inverting all ratios greater than unity, and averaging all positive values. Thereafter, a coefficient vector 36 is produced by multiplying the inverted overlap matrix 30 by the overlap vector 34. An estimate of the array 32 is generated at 38 by multiplying the data matrix 22 onto the coefficient vector 36. The linear combination coefficients can be summed and each coefficient is divided by that sum to produce a final list of linear combination coefficients. This step ensures that the estimate 38 lies within the range of the data matrix 22.

The estimate 38 is then compared 40 to the actual array 32 via the overlap process as used in 24 and 34 to yield a single number between 0 and +1.0. This number is then compared to the largest of the numbers in the overlap vector 34 and in order to validate the current observation 42. The number 40 is then subtracted from 1 and the result multiplied by 100, at 44, to yield the allowable percentage error of each individual signal in the current observation 32. As shown at 46, if any individual signal value estimate of the array 38 differs by more than the allowable error 44 from the current observation 32, that individual signal value in the current observation 32 is tagged as an unacceptable number. In this case, the signal value of the current observation 32 can be replaced by the estimated signal value 38 thereby "ignoring" an improper value indicated at 32. Therefore, if the result of this process as indicated at 46 is an error percent difference less than that indicated at 44, for all individual signals involved, then the system is deemed to be working properly without any parameters observed outside allowable limits.

EXAMPLE 1

Assume a simple system with four parameters which indicate the state of the system. Example 1 of "Rectification of Process Measurement Data in the Presence of Gross Errors", J. A. Ramagnoli and G. Stephanopoulos, *Chemical Engineering Science*, Vol. 36, No. 11, 1981 illustrates a small system that satisfies the constraint equations $$0.1X(1)+0.6X(2)-0.2X(3)-0.7X(4)=0$$

$$0.8X(1)+0.1X(2)-0.2X(3)-0.1X(4)=0$$

$$0.1X(1)+0.3X(2)-0.6X(3)-0.2X(4)=0$$

and poses the question whether or not the set of measurements $$X(1)=0.1739,\ X(2)=5.0435,\ X(3)=1.2175 \text{ and } X(4)=4.00$$

even though they pass all conventional validation tests, are truly valid. Assume that the true state parameter values are known to be:

$$X(1)=0.1739$$

$$X(2)=5.0435$$

$$X(3)=1.2175$$

$$X(4)=4.00 \tag{5}$$

and that the set of measurements has been generated from them by applying normal distributions of varying standard deviations to each of the true state parameters. Further assume that one of the measurements is in error by a relatively large number of standard deviations. Standard statistical approaches, equivalent to using constraint equations to determine the best of four different fits of three parameters at a time, isolates parameter X(2) to be the faulty measurement and determines the following estimates for the remaining three: X(1)=0.1751, X(3)=1.226, and X(4)=4.027.

Using the process of the present invention, a set of learned states is generated from the constraint equations and formed into a data matrix:

$$D = \begin{vmatrix} 0.16 & 0.18 & 0.20 & 0.22 \\ 4.64 & 5.22 & 5.80 & 6.38 \\ 1.12 & 1.26 & 1.40 & 1.54 \\ 3.68 & 4.14 & 4.60 & 5.06 \end{vmatrix}$$

Four learned states are arbitrarily generated, however any convenient number greater than two can be used. The learned states noted above encompass which in vector form appears as $$O(i) = \begin{vmatrix} 0.1858 \\ 4.7935 \\ 1.2295 \\ 3.8800 \end{vmatrix}$$

Before making the final estimate, the process of this invention calculates the adaptive coefficients (step 36 in FIG. 2):

$$C(i) = \begin{vmatrix} .3706 \\ .5542 \\ .0752 \\ .0000 \end{vmatrix}$$

The adaptive coefficients show that coefficient No. 2 is the largest, indicating the learned state No. 2 is the state closest to the current observation from a pattern recognition standpoint. The estimate created by this process is the product (step 38 of FIG. 2) of the data matrix and the adaptive coefficients:

$$E(i) = DC(i) = \begin{vmatrix} 0.16 & 0.18 & 0.20 & 0.22 \\ 4.64 & 5.22 & 5.80 & 6.38 \\ 1.12 & 1.26 & 1.40 & 1.54 \\ 3.68 & 4.14 & 4.60 & 5.06 \end{vmatrix} \times \begin{vmatrix} .3706 \\ .5542 \\ .0752 \\ .0000 \end{vmatrix} =$$

$$\begin{vmatrix} 0.1741 \\ 5.0487 \\ 1.2187 \\ 4.0041 \end{vmatrix} +/- \ 3.83\%$$

The parameters of this estimate are quite close to the actual values noted above, without any knowledge in the process that the second parameter in the observation is defective.

The uncertainty of the estimate (a relatively high 3.83%) results from the pattern mismatch between the estimate E(i) and the current observation O(i) (step 44 of FIG. 2). Stated differently, this uncertainty results from the question of whether or not the observation is truly a member of the learned domain. To illustrate, the true value of the observations (equation (5) above) can be taken, which are known to satisfy the constraint equations and therefore are truly within the learned domain. The observation vector is $$O(i) = \begin{vmatrix} 0.1739 \\ 5.0435 \\ 1.2175 \\ 4.0000 \end{vmatrix}$$

and the adaptive coefficients $$C(i) = \begin{vmatrix} .2918 \\ .7082 \\ .0000 \\ .0000 \end{vmatrix}$$

are multiplied by the data matrix as above, resulting in an estimate of $$E(i) = DC(i) = \begin{vmatrix} 0.16 & 0.18 & 0.20 & 0.22 \\ 4.64 & 5.22 & 5.80 & 6.38 \\ 1.12 & 1.26 & 1.40 & 1.54 \\ 3.68 & 4.14 & 4.60 & 5.06 \end{vmatrix} \times \begin{vmatrix} .2918 \\ .7082 \\ .0000 \\ .0000 \end{vmatrix} =$$

$$\begin{vmatrix} 0.1742 \\ 5.0507 \\ 1.2191 \\ 4.0058 \end{vmatrix} +/- \ 0.14\%$$

Note the similarity to the previous estimates, with particular note that the level of uncertainty (step 44 in FIG. 2) is significantly lower because this observation truly lies within the learned domain.

By utilizing the process of this invention, visual displays can be created, as for example on a computer screen or a continuous graph, which indicate the performance of the process under consideration. Process parameters having relevance as indicators of the state of the process can be chosen for manipulation by the process of this invention. An individual familiar with the system parameters chooses independent variables, any one of which can affect the performance of the other variables. Learned observations can be recorded for a period of time sufficient to satisfy the requirement that they accurately reflect an acceptably operating system under the given set of parameters. The learned periods can be as short as tenths of seconds or as long as many hours. It is generally assumed that, during the learn period, data for all parameters chosen for analysis are operating within normal ranges.

EXAMPLE 2

Figure 3:
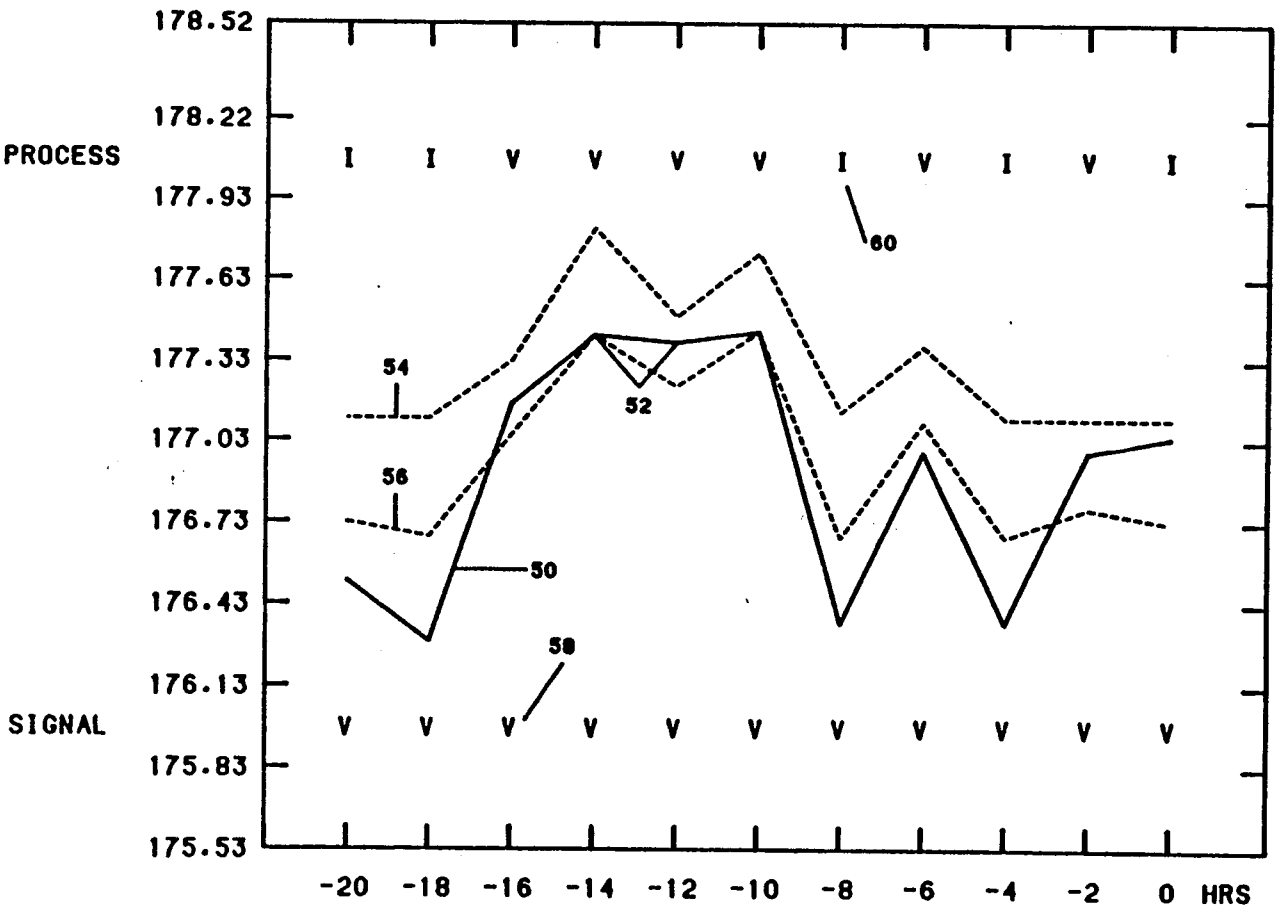
FIG. 3 is a graph illustrating the results of the process of the present invention on a first variable (coolant temperature)

In the example of a nuclear power electric generating facility, as many as 100–200 parameters may be selected for periodic review. while most of such parameters will not be "controlling" or critical to proper plant operation, they are reviewed to maintain a knowledge of those parameters which might affect the process control. FIG. 3 illustrates a graph of the monitoring of parameter No. 94—the reactor coolant temperature as a function of time. This parameter is one of the primary controls for proper reactor function. The solid line 50 and data points indicated by "X" 52 indicate actual measurements of the current observations over a 20-hour period as measured every 2 hours, while the broken lines 54 and 56 define a prediction band which illustrates the estimated value of parameter No. 94, plus or minus the uncertainty (step 44 of FIG. 2), when compared to the other parameters measured at the same time. A current observation 52 is deemed to be "valid" (illustrated by the "V" indication 58 beneath each observation 52) if it is within one prediction band width above or below the upper or lower limit respectively. As noted in FIG. 3, all of the observations are valid, and this particular process variable is operating as expected. However, the process is sometimes "invalid" (illustrated by the "I" indication 60 above same observations) due to improper operation by one or more of the other variables controlling this process. "Invalid" in this sense means that the overall process (as opposed to the individual variable) is not operating within the expected or predicted range (as determined in step 42 of FIG. 2). In this example, 123 parameters are continuously monitored and it is apparent that the prediction band of parameter No. 94 closely tracks the actual temperature as observed. The percent error in the example of FIG. 3 is approximately 0.1%.

Figure 4:
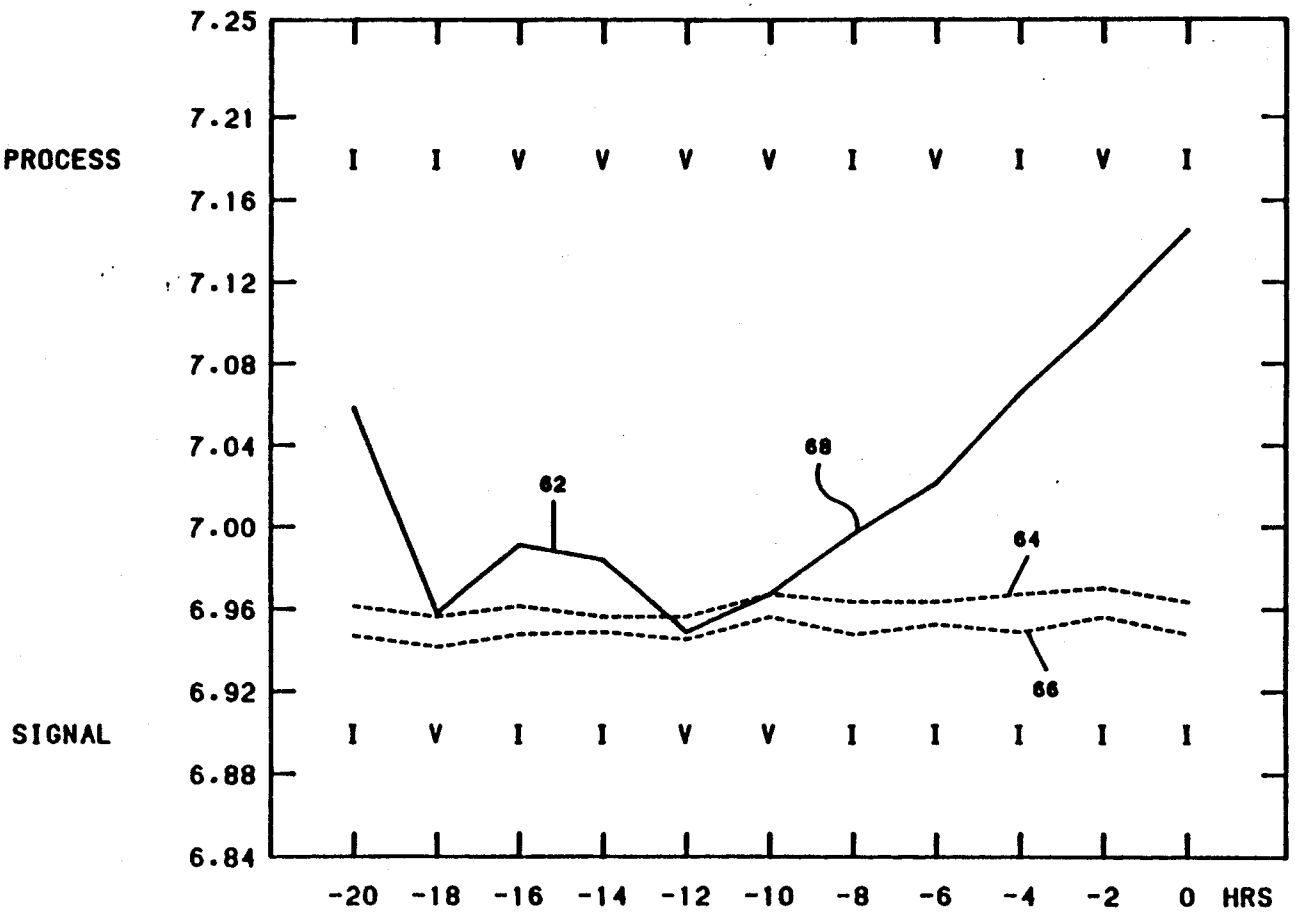
FIG. 4 is a graph illustrating the results of the process of the present invention on a second variable (coolant flow).

FIG. 4 illustrates a graph of parameter No. 37, a measure of coolant flow which should be a relatively constant number. It is quite apparent that the observed values 62 do not correlate well with the estimated values of the prediction band 64, 66 obtained, as above, by use of the process of the present invention. One of two conclusions may be drawn from such data: either the parameter chosen does not correlate well with the other 122 parameters and therefore should not be monitored, or that the signal 62 reflected by current observations 68 is in error, probably due to defective instrumentation. It is assumed that before a parameter is chosen for monitoring, a reasoned judgment has been made that the parameter does in fact correlate well in the process, so that a graph as in FIG. 4 must indicate defective instrumentation. Expert opinion, as well as history, in this case indicate that this variable should be well correlated with the others and that therefore the current observations 68 are not reliable. It is assumed that a fault exists in the signal, either in its data acquisition or the output of the monitoring device.

This judgment is confirmed by FIG. 4, wherein zero hours is approximately 11:00 a.m. It is apparent that workers at this plant noticed the parameter out of bounds at −20 hours (3:00 p.m.) and made adjustments to bring it back into a "valid" condition. After drifting out of bounds again at −16 and −14 hours, it was again brought back to validity. However, after a personnel shift change at midnight (−11 hours), the new shift ignored this parameter and let it drift uncontrolled.

The trend of current observations at times previous to −18 and −16 hours provide an operator with the knowledge that the monitor of the particular parameter is indicating a trend toward, and has in fact reached, an "invalid" condition. Corrective action (usually in the nature of fine-tuning the monitor) improves the parameter (at −18 and −12 hours) before it moves severely out of the expected range.

FIG. 4 illustrates an important feature of the present invention—that is, the ability to recognize a drifting signal which, although still within the ranges established as "normal", indicates a problem. Heretofore, as in the example of FIG. 4, values of from, e.g. 6.75–7.10 mV may have been set to accommodate the normal variation in coolant flows. Only if the coolant flow was outside these ranges would an operator take action. Using the process of the present invention a much more narrow prediction band can be established. The present invention enables an operator to estimate where a particular parameter "should" be at a particular point in the process, while at the same time displaying where the current observation is, and permits the operator to make a judgment that while the parameter is still within the "normal" range, it is trending toward the limits of the range, indicating a malfunction. Such observation permits the operator to identify and attempt to correct the malfunction before the preset normal range limits are reached, thereby preventing operation outside such ranges.

As described above, it should be apparent that a parameter, such as that of FIG. 4 at times −8 to 0 hours, is not *actually* operating outside the expected range, but rather the monitoring of the parameter is faulty. Such incorrect instrumentation can have serious consequences, as they either induce an operator to erroneously adjust other parameters in an attempt to "fix" the parameter in question, or the process or plant automatically makes such adjustments. In either case, because the "invalid" signal is a result of monitoring error and not a result of the process variability, such changes can adversely impact the proper functioning of the process or plant.

It is to be understood that while the process of the present invention has been described above to form a pattern overlap by forming ratios, of direct signal values, such process may be configured to include any functional transformation of the process variables rather than their actual measured values. Furthermore, combinations of like signal values other than ratios may be used in the process of the present invention. For instance, the square, exponential or cosine of any variable may be utilized in the formation of the pattern overlaps. It is the underlying relative values, not their arithmetic or trigonometric conversion before they are overlapped, which is of interest herein.

While a preferred embodiment of the invention has been disclosed, various modes of carrying out the principles disclosed herein are contemplated as being within the scope of the following claims. Therefore, it is understood that the scope of the invention is not to be limited except as otherwise set forth in the claims.

I claim:

1. In a multi-variable process, a method for controlling the process within predetermined process parameters, comprising the steps of:
   a. capturing and recording a range of valid examples of a plurality of process variables when the process is running in an acceptable condition, and determining the pattern overlap of all pairs of such examples;
   b. periodically acquiring current observations of the process variables and determining the pattern overlap of each such current observation of each of the examples of step a;
   c. obtaining an operator from the pattern overlap of step a and applying it to the pattern overlap of step b to produce an adaptive linear combination of said examples;
   d. comparing the current observations to the linear combination of step c to determine the validity of the current observation; and
   e. indicating the results of step d to enable a determination to be made whether the current observation indicates the process to be operating within the range of valid examples of step a.

2. In a multi-variable process, a method of controlling the process within predetermined process parameters, comprising the steps of:
   a. capturing and recording a range of valid examples of a plurality of process variables when the process is running in an acceptable condition, and determining the pattern overlap of all pairs of such examples;
   b. periodically acquiring current observations of the process variables and determining the pattern overlap of each such current observation of each of the examples of step a;
   c. obtaining an operator from the pattern overlap of step a and applying it to the pattern overlap of step b to produce an adaptive linear combination of said examples;
   d. comparing the current observations to the linear combination of step c to determine the validity of the current observation;
   e. indicating the results of step d to enable a determination to be made whether the current observation indicates the process to be operating within the range of valid examples of step a; and
   f. indicating the results of step e. to enable a determination to be made whether the current observations contain valid examples of process variables.

3. In a multi-variable process, a method for controlling the process within predetermined process parameters, comprising the steps of:
   a. capturing and recording a range of valid examples of process variables as learned observations;
   b. deriving an operator from the learned observations and applying it to current observations to produce an adaptive linear combination of learned observations; and
   c. comparing the current observations to the combination of learned observations to determine the validity of the current observations.

4. The method as recited in claim 3, further comprising indicating the results of step c to enable a determination to be made whether the current observation indicates the process and particular process variable to be operating within the range of valid examples.

* * * * *

US004937763C1

(12) EX PARTE REEXAMINATION CERTIFICATE (5092nd)

United States Patent
Mott

(10) Number: US 4,937,763 C1
(45) Certificate Issued: Apr. 5, 2005

(54) METHOD OF SYSTEM STATE ANALYSIS

(75) Inventor: Jack E. Mott, Idaho Falls, ID (US)

(73) Assignee: Smartsignal Corp., Lisle, IL (US)

Reexamination Request:
No. 90/006,720, Jul. 21, 2003
No. 90/007,013, Apr. 22, 2004

Reexamination Certificate for:

| | |
|---|---|
| Patent No.: | **4,937,763** |
| Issued: | **Jun. 26, 1990** |
| Appl. No.: | **07/240,262** |
| Filed: | **Sep. 6, 1988** |

(51) Int. Cl.[7] ..... G06F 19/00; G05B 13/02
(52) U.S. Cl. ..... 702/183; 700/52; 700/47
(58) Field of Search ..... 702/183; 700/28, 700/29, 30, 31, 47, 48, 49, 50, 51, 52

(56) References Cited

U.S. PATENT DOCUMENTS 4,620,286 A * 10/1986 Smith et al. ..... 706/12
4,630,189 A 12/1986 Ohmori et al.
4,812,995 A * 3/1989 Girgis et al. ..... 700/292

OTHER PUBLICATIONS

Mott et al., "Application of State Analysis Technology to Surveillance Systems", IEEE, 1989.*
Astrom et al., Computer Controlled Systems: Theory and Design, pp. 166& 254–255, 1984.*
Excerpt from *Nuclear News*, vol. 28/No. 13, dated Oct. 1985 (table of contents and p. 13) (2 pages).
Excerpt from *Nuclear News*, vol. 29/No. 7, dated May 1986 (table of contents and p. 10) (2 pages).
Excerpt from *Nuclear News*, vol. 29/No. 9, dated Jul. 1986 (table of contents and pp. 135–140) (7 pages).
Excerpt from *Nuclear News*, vol. 29/No. 13, dated Oct. 1986 (cover, table of contents and pp. 10–14) (4 pages).
Excerpt from *Nuclear News*, vol. 30/No. 3, dated Mar. 1987 (cover, table of contents and p. 8) (3 pages).
Excerpt from *Nuclear News*, vol. 30/No. 8, dated Jun. 1987 (cover, table of contents and pp. 162–170) (11 pages).
Excerpt from *Nuclear News*, vol. 29/No. 10, dated Aug. 1986 (cover, table of contents and pp. 17–19) (5 pages).
Excerpt from *Transactions*, (supplement No. 1 to vol. 54, dated Aug. 1987 (contents and technical sessions) (10 pages).
Excerpt from the book entitled *Artificial Intelligence and Other Innovative Computer Applications in the Nuclear Industry*, published on or after Oct. 14, 1988 by Plenum Press (Preface, Table of Contents and Attendees) (21 pages).
Excerpts from the book entitled *Proceedings of the International Topical Meeting on Operability of Nuclear Power Systems in Normal and Adverse Environments* published by the American Nuclear Society, Inc. This excerpt consists of the table of contents (10 pages) and a paper entitled "EBR–II Systems Surveillance Using Pattern Recognition Software" (8 pages).
J.E. Mott, et al., EBR–II (Experimental Breeder Reactor–II) System Surveillance Using Pattern Recognition Software, DOE Report No. CONF–860908–40, OSTI Identifier DE87 004974, Feb. 1986. Proceeding of ANS/ENS Topical Meeting on Operability of Nuclear Power Systems in Normal and Adverse Environments, Albuquerque, New Mexico, Sep. 29 through Oct. 3, 1986.

(Continued)

*Primary Examiner*—Patrick Assouad

(57) ABSTRACT

A process for monitoring a system by comparing learned observations acquired when the system is running in an acceptable state with current observations acquired at periodic intervals thereafter to determine if the process is currently running in an acceptable state. The process enables an operator to determine whether or not a system parameter measurement indicated as outside preset prediction limits is in fact an invalid signal resulting from faulty instrumentation. The process also enables an operator to identify signals which are trending toward malfunction prior to an adverse impact on the overall process.

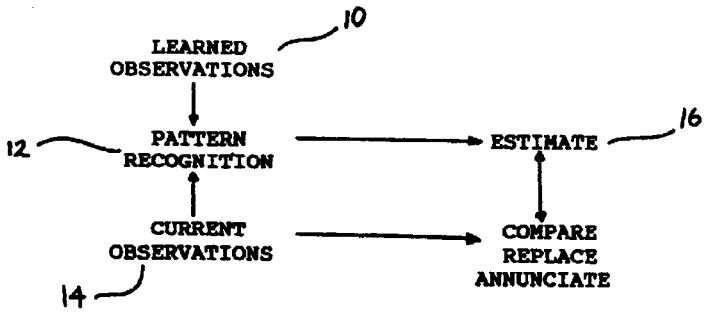

OTHER PUBLICATIONS

J. Mott, et al., Pattern Recognition Software for Plant Surveillance, DOE Report No. CONF–870837–1, OSTI Identifier DE88 003029. Proceeding of the ANS/ENS International Meeting on Nuclear Power Plant Operation, Chicago, Illinois, Aug. 30 through Sep. 3, 1987.

J. Mott, et al., A Generalized System State Analyzer for Plant Surveillance, DOE Report No. CONF–870823–7, OSTI Identifier DE88 003027. Proceeding of the Topical Meeting on Artificial Intelligence and Other Innovative Computer Applications in the Nuclear Industry, Snowbird, Utah, Aug. 31 through Sep. 2, 1987.

R.E. Kalman, A New Approach to Linear Filtering and Prediction Problems, Transactions of the ASME—Journal of Basic Engineering, 82 (Series D): 35–45 1960.

Complaint (without Exhibit A, which is U.S. Pat. No. 4,937,763) in *SmartSignal Corporation v. Expert Microsystems, Inc.,* Civil Action No. 02C 7682, U.S. District Court, Northern District of Illinois ("the Litigation"), dated Oct. 25, 2002 (4 pages). A copy of this reference is contained in the Appendix in Support of Response to Office Action In Ex Parte Reexamination.

Defendant's Answer and Counterclaim for Declaratory Judgement in the Litigation, dated Dec. 2, 2002 (4 pages). A copy of this reference is contained in the Appendix In Support of Response to Office Action In Ex Parte Reexamination.

Plaintiff's Reply to Defendant's Counterclaim, dated Dec. 23, 2002 (7 pages).

Response of Defendant Expert Microsystems, Inc. to Plaintiff's First Set of Interrogatories in the Litigation (with selected portions redacted pursuant to Court Order), dated Feb. 18, 2003 (119 pages). A copy of this reference is contained in the Appendix In Support of Response to Office Action In Ex Parte Reexamination.

Plaintiff's Response to Defendant's First Set of Interrogatories (Nos. 1–32) in the Litigation (with selected portions redacted pursuant to Court Order), dated Mar. 28, 2003 (58 pages). A copy of this reference is contained in the Appendix In Support of Response to Office Action In Ex Parte Reexamination.

Letter of Mark W. Hetzler (counsel for Plaintiff) to Audrey A. Millemann (counsel for Defendant), dated Aug. 19, 2003 (2 pages). A copy of this reference is contained in the Appendix In Support of Response to Office Action In Ex Parte Reexamination.

Plaintiff's Response to Defendant's Motion for Stay in Litigation (without Exhibits), dated Aug. 8, 2003 (5 pages). A copy of this reference is contained in the Appendix In Support of Response to Office Action In Ex Parte Reexamination.

Court Order staying the Litigation pending resolution of the instant reexamination proceeding and permitting the depositions of the U.S. Department of Energy and Kluwer Academic Publishers/Plenum Publishing Corporation, dated Aug. 15, 2003 (1 page). A copy of this reference is contained in the Appendix In Support of Response to Office Action In Ex Parte Reexamination.

Declaration of Dr. Jack E. Mott under 37 C.F.R. §1.132 with attachment, dated Dec. 22, 2003 (18 pages). A copy of this reference is contained in the Appendix In Support of Response to Office Action In Ex Parte Reexamination.

Declaration of Sharon M. Jordan (employee of the U.S. Department of Energy), including Exhibits A–M thereto, Aug. 8, 2003 (319 pages). A copy of this reference is contained in the Appendix In Support of Response to Office Action In Ex Parte Reexamination.

Declaration of Scott Delman (employee of Kluwer Academic Publishers/Plenum Publishing Corporation), including Exhibits A–M thereto, Aug. 11, 2003 (18 pages). A copy of this reference is contained in the Appendix In Support of Response to Office Action In Ex Parte Reexamination.

Transcript of deposition of the U.S. Department of Energy (designee Sharon M. Jordan) and deposition Exhibits 38 and 39, dated Oct. 2, 2003 (28 pages). A copy of this reference is contained in the Appendix In Support of Response to Office Action In Ex Parte Reexamination.

Transcript of deposition of Kluwer Academic Publishers/Plenum Publishing Corporation (designee Scott Delman) and deposition Exhibit 36, dated Sep. 25, 2003 (25 pages). A copy of this reference is contained in the Appendix In Support of Response to Office Action In Ex Parte Reexamination.

Deyst, John J. Jr., et al., *Sensor Validation: A Method to Enhance the Quality of the Man/Machine Interface in Nuclear Power Stations*, IEEE Transactions on Nuclear Science, vol. NS–28, No. 1, Feb. 1981, pp. 886–890 (5 pages).

Golden, G. et al., *Evolution of Thermal–hydraulics Testing in EBR–II*, Nuclear Engineering and Design, vol. 101, 1987, pp. 3–12 (10 pages).

Hashemi, S. et al., *An Expert System for Sensor Data Validation and Malfunction Detection*, Artificial Intelligence and Other Innovative Computer Applications in the Nuclear Industry, Plenum Press New York, Oct. 1988, pp. 149–156 (8 pages).

Hopfield, J. J., *Neural Networks and Physical Systems with Emergent Collective Computational Abilities*, Proceedings of the National Academy of Sciences, vol. 79, No. 8, Apr. 1982, pp. 2554–2558 (9 pages).

Isermann, Rolf, *Process Fault Detection Based on Modeling and Estimation Methods—A Survey*, Proceedings of the 6$^{th}$ International Federation of Automatic Control Symposium on Identification and System Parameter Estimation, Washington, D.C., Jun. 7–11, 1982, pp. 387–404 (18 pages).

King, R. W. et al., *Pattern–Recognition System Application to EBR–II Plant –Life Extension*, U.S. Department of Energy Report No. CONF–880748—6, Office of Scientific and Technical Information (OSTI) Identifier DE88 012043 (published by the U.S. Department of Energy after Aug. 2, 1988 (12 pages).

Lewi, Paul J., *Projection of a Data Structure Upon an Axis*, Multivariate Data Analysis in Industrial Practice, Chapter 6, 1982, pp. 79–93 and 237–242 (23 pages).

Minsky, M. A. et al., *Perceptrons*, (Cambridge, Mass., MIT Press, 1969), Chapter 13, pp. 227–246 (14 pages).

Mott, J. et al., *A Generalized System State Analyzer for Plant Surveillance*, U.S. Department of Energy Report No. CONF–870832—7, Office of Scientific and Technical Information (OSTI) Identifier DE88 003027 (published by the U.S. Department of Energy after Feb. 4, 1988)(18 pages).

Mott, J. et al., *Pattern–Recognition Software Detecting the Onset of Failures in Complex Systems*, U.S. Department of Energy Report No. CONF–8709204–1, Office of Scientific and Technical Information (OSTI) Identifier DE88 002861 (published by the U.S. Department of Energy after Feb. 4, 1988) (18 pages).

Mott, J. et al., *Pattern–Recognition Software for Plant Surveillance*, U.S. Department of Energy Report No. CONF–870837—1, Office of Scientific and Technical Information (OSTI) Identifier DE88 003029 (published by the U.S. Department of Energy after Feb. 4, 1988) (33 pages).

Mott, J. et al., *Pattern–Recognition Software for Plant Surveillance*, Transactions of the American Nuclear Society, Supplement No. 1 to vol. 54, Aug. 1987, pp. 151–152 (4 pages).

Ramagnoli, J. A. et al., *Rectification of Process Measurement Data in the Presence of Gross Errors*, Chemical Engineering Science, vol. 36, No. 11, 1981, pp. 1849–1863, (15 pages).

Ray, A. et al., *Fault Detection and Isolation in a Nuclear Reactor*, Journal of Energy, vol. 7, Jan.–Feb. 1983, pp. 79–85 (7 pages).

Ray, A. et al., *On–line Signal Validation and Feedback Control in a Nuclear Reactor*, Fourth Power Plant Dynamics, Control & Testing Symposium, Knoxville, Tennessee, 1983, pp. 38.01–38.20 (20 pages).

Rosenblatt, F., *The Perceptron: A Probabalistic Model for Information Storage and Organization in the Brain*, Psychological Review, vol. 65, 1958, pp. 386–408 (23 pages).

Rumelhart, D. E. et al., *Learning Internal Representations by Error Propagation*, Parallel Distributed Processing, MIT Press, 1986, pp. 318–362 (45 pages).

Uhrig, Robert E., *Applications of Artificial Intelligence in the U.S. Nuclear Industry*, Artificial Intelligence and Other Innovative Computer Applications in the Nuclear Industry, Plenum Press New York, Oct. 1988, pp. 11–19 (11 pages).

Upadhyaya, B. R. et al., *An Integrated Approach for Signal Validation in Nuclear Power Plants*, Artificial Intelligence and Other Innovative Computer Applications in the Nuclear Industry, Oct. 1988, pp. 167–174 (10 pages).

Upadhyaya, B. R. et al., *An Integrated Architecture for Signal Validation in Power Plants*, Third IEEE International Symposium on Intelligent Control, Arlington, Virginia, Aug. 24–26, 1988, pp. 681–686 (8 pages).

Widrow, G., *Adaptive Switching Circuits*, IRE WESCON Convention Record, 1960, pp. 96–104 (9 pages).

Zedah, L. A., *A Theory of Approximate Reasoning*, Machine Intelligence, vol. 9 (Chichester, Horwood, 1979), Chapter 7, pp. 149–194, (48 pages).

* cited by examiner

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–4 is confirmed.

New claims 5–23 are added and determined to be patentable.

*5. A method in accordance with claim 3 wherein the step of deriving an operator comprises determining first pattern overlaps of learned observations with each other and second pattern overlaps of current observations with learned observations.*

*6. A method in accordance with claim 5 wherein at least one of the first pattern overlap and the second pattern overlap is determined by comparison of like process variables from each of two observations being overlapped.*

*7. A method in accordance with claim 6 wherein at least one of the first pattern overlap and the second pattern overlap is further determined by averaging the comparisons of like process variables to provide a measure of similarity of two observations.*

*8. A method in accordance with claim 5 wherein said first pattern overlaps are multiplied by said second pattern overlaps to produce coefficients for the adaptive linear combination of learned observations.*

*9. A method in accordance with claim 8 wherein the adaptive linear combination is generated by combining the learned observations according to the coefficients.*

*10. A method in accordance with claim 8 wherein the coefficients for the adaptive linear combination are summed to a total and the coefficients are divided by the total to produce second coefficients.*

*11. A method in accordance with claim 10 wherein the adaptive linear combination is generated by combining the learned observations according to the second coefficients.*

*12. A method for monitoring a system having instrumented process variables comprising the steps of:*

*a. acquiring and storing at least two exemplary observations of two or more process variables when the system is running acceptably and performing a pattern overlap by determining measurements of similarity for pairs of exemplary observations by comparing like process variables from pairs of exemplary observations to determine a value of relative closeness of the like process variables and combining the values into a single measurement per pair of exemplary observations;*

*b. acquiring at least one monitored observation of two or more process variables and for each monitored observation performing a pattern overlap by determining measurements of similarity between the monitored observation and individual exemplary observations;*

*c. obtaining an operator by arranging the similarity measurements of step a into an overlap matrix and inverting the matrix;*

*d. arranging the similarity measurements of step b into an overlap vector and multiplying the operator times the overlap vector;*

*e. multiplying the exemplary observations of step a times the results of step d to produce an adaptive linear combination of the exemplary observations;*

*f. comparing the monitored observation to the adaptive linear combination; and*

*g. providing the results of step f to enable a determination of whether the system is operating acceptably as characterized by the exemplary observations of step a.*

*13. A method in accordance with claim 12 wherein determining a value of relative closeness of like process variables comprises forming a ratio of like process variables.*

*14. A method in accordance with claim 12 wherein determining a value of relative closeness of like process variables comprises forming a cosine function of like process variables.*

*15. A method in accordance with claim 12 wherein determining a value of relative closeness of like process variables comprises forming an exponential function of like process variables.*

*16. A method in accordance with claim 12 wherein at least one of the process variables is functionally transformed from its acquired value.*

*17. A method in accordance with claim 13 further comprising the step of inverting all ratios greater than unity.*

*18. A method in accordance with claim 12 wherein combining the values comprises averaging the values.*

*19. A method in accordance with claim 12 wherein comparing comprises determining a pattern overlap of the adaptive linear combination and the monitored observation.*

*20. A method in accordance with claim 19 wherein the step of comparing further comprises comparing the result of the pattern overlap to a predetermined threshold indicative of system state.*

*21. A method in accordance with claim 20 wherein the predetermined threshold is indicative of system health.*

*22. A method in accordance with claim 20 wherein the predetermined threshold is indicative of instrument health.*

*23. A method in accordance with claim 20 wherein the predetermined threshold is indicative of system's acceptable operating state.*

* * * * *